United States Patent [19]

Kidowaki et al.

[11] 4,254,817

[45] Mar. 10, 1981

[54] METAL CASTING APPARATUS

[75] Inventors: Yoshimasa Kidowaki, Osaka; Shiro Okamoto, Shigaken, both of Japan

[73] Assignee: Iwatani Sangyo Kabushiki Kaisha, Osaka, Japan

[21] Appl. No.: 43,613

[22] Filed: May 30, 1979

[51] Int. Cl.[3] ..... B22D 18/00; B22D 18/06; B22D 27/02

[52] U.S. Cl. ..... 164/252; 164/284; 164/259; 164/254

[58] Field of Search ..... 164/52, 252, 66, 67, 164/68, 61, 62, 63, 65, 253, 254, 255, 259, 34, 35, 133, 113, 284, 366

[56] References Cited

U.S. PATENT DOCUMENTS

| | | | |
|---|---|---|---|
| 2,125,080 | 7/1938 | Merrick | 164/252 |
| 3,788,382 | 1/1974 | Daniel et al. | 164/255 X |
| 4,150,707 | 4/1979 | Emerick | 164/52 |

*Primary Examiner*—Robert D. Baldwin
*Assistant Examiner*—K. Y. Lin
*Attorney, Agent, or Firm*—Bacon & Thomas

[57] ABSTRACT

A casting furnace includes upper and lower chambers, separated by a wall having a pouring path extending therethrough. A crucible is positioned in the upper chamber and a mold is positioned in the lower chamber, both in alignment with the pouring path. A body of casting metal is placed in the crucible and is melted from the top down by an electric arc generated in the upper chamber, the bottom portion of the body of casting metal blocking the pouring path until the casting metal has become molten. Thereafter, the molten casting metal falls by gravity through the pouring path, and into the mold. The arrangement is such that the molten metal requires nothing but the force of gravity to enter the mold cavity.

20 Claims, 21 Drawing Figures

METAL CASTING APPARATUS

TECHNICAL FIELD OF THE INVENTION

The present invention relates generally to metal casting apparatus, of the kind adapted for melting small charges of metal and casting objects such as dental inlays, jewelry, precious metal works, and precision machine parts. More particularly, the invention relates to an improved metal casting apparatus for such use, employing a metal-heating crucible in communication with a mold via an opening through which molten metal from the crucible is automatically let into the mold by gravity, without the employment of any intermediate means and/or process.

BACKGROUND OF THE INVENTION

An example of the general kind of apparatus to which this invention relates is disclosed in U.S. Pat. No. 3,788,382. In the apparatus disclosed in this patent, a metal is electrically heated in a crucible to optimum casting temperature. The temperature of the molten metal is sensed and, in response to such sensing, the molten metal is sucked under vacuum into a mold through an opening provided in the bottom of the crucible, with the vacuum being produced in the mold. In practice, apparatus such as that shown in the noted patent tends to have certain disadvantages, among which are the following:

(a) The products made with such apparatus are prone to having faults therein. The reasons for such faults can be traced to a number of factors: (1) the range of the optimum casting temperatures is unfavorably limited; (2) the detector of the optimum temperature may fail to detect an average temperature of the whole body of the molten metal, in which temperature can differ from spot to spot, thereby resulting in an improper detection of the temperature so that the molten metal is sucked into the mold either too soon or too late; and (3) there is inherent in the arrangement an unavoidable time lag between the detection of the optimum temperature and the initiation of the suction vacuum, during which time lag the molten metal is in danger either of excessive heating or detrimental cooling. When excessively heated, the metal is liable to form rough surfaces, blowholes and pinholes. When cooled below the optimum casting temperature the molten metal lacks its optimum fluidity and, for this reason, can fail to reach deeply enough into molding cavities. Accordingly, when the temperature of the molten metal is not optimum, it sometimes happens that a particular desired shape or surface condition for an object cannot be achieved, and other related problems can be encountered.

(b) The melting temperature and the optimum casting temperature are different, depending upon the kind of metal. When using apparatus like that shown in the patent, a complicated procedure is required for predetermining the optimum melting temperature.

(c) A temperature detector device and an electronic control device connected with the detector and arranged to operate a vacuum pump in response to the detection of a specific temperature by the detector are required in apparatus like that shown in the patent. These devices require a high degree of reliability and, with their inclusion, the apparatus as a whole becomes both expensive and complicated.

(d) In apparatus like that shown in the patent, the reliability of the temperature detector device and of the electronic control device must be maintained, requiring a constantly ongoing, labor-consuming maintenance effort. But even with such a maintenance effort, the life of these devices tends to be short.

(e) In order to perform the resistance heating of a metal in the apparatus of the patent, a vertically split type of crucible is employed, with an insulating plate interposed between its paired sides. In addition, a backing means must be provided for securing the metal in between the paired sides of the crucible. This arrangement again requires expensive maintenance, and makes the apparatus structurally complicated and costly.

BRIEF SUMMARY OF THE INVENTION

In the present invention, the metal casting apparatus includes a metal-heating crucible which is located above a mold, there being a liquid passageway located between the crucible and the mold. An electric heating means is located above the metal-heating crucible, so as to melt casting metal placed in the crucible from the top of the casting metal to its bottom, the arrangement being such that the casting metal is simply allowed to drop by gravity through the passageway and into the mold after it has become molten.

According to another aspect of the invention, the use of the force of gravity to cause the molten material metal to fall into the mold is supplemented by a gas pressure differential produced between the heating section and the molding section of the apparatus.

It is the principal object of the present invention to provide a metal casting apparatus in which an optimum casting temperature for the casting metal is maintained until the molten metal enters the mold, thereby assuring a precise molding of the desired object even when fine, delicate shaping and a smooth surface are required.

Another object is to provide a metal casting apparatus capable of trouble-free operation and easy adjustment of the casting temperature, even when different casting materials are used.

A further object is to provide a metal casting apparatus having a simplified construction, thereby reducing the costs of production and maintenance.

Other objects and many of the attendant advantages of the invention will become readily apparent from the following detailed description of the preferred embodiments, when taken together with the accompanying drawings.

DETAILED DESCRIPTION OF THE PREFERRED EMBODIMENTS

Figure 1:
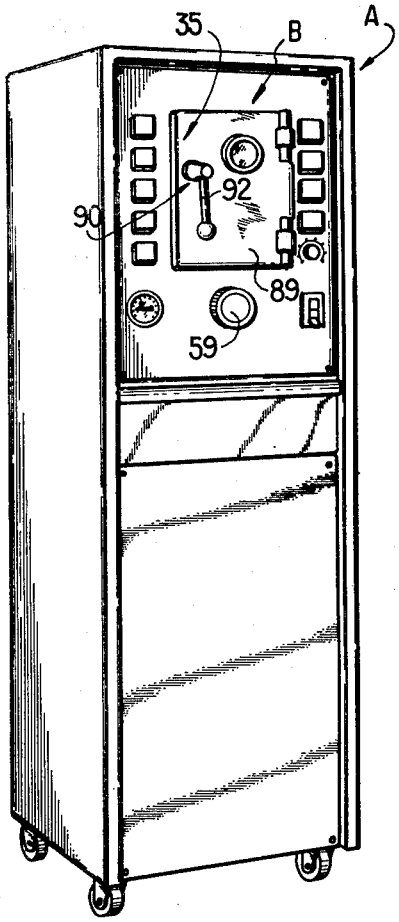
FIG. 1 is a perspective view of a cabinet in which is mounted a metal casting apparatus constructed according to the present invention.
Figure 2:
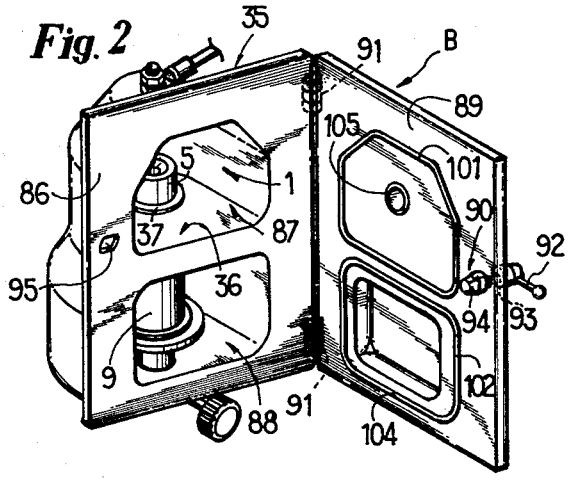
FIG. 2 is a perspective view on an enlarged scale of the casting unit of the metal casting apparatus of FIG. 1, shown with the door thereof open for viewing the interior of the upper, heating chamber and the lower, molding chamber.
Figure 3:
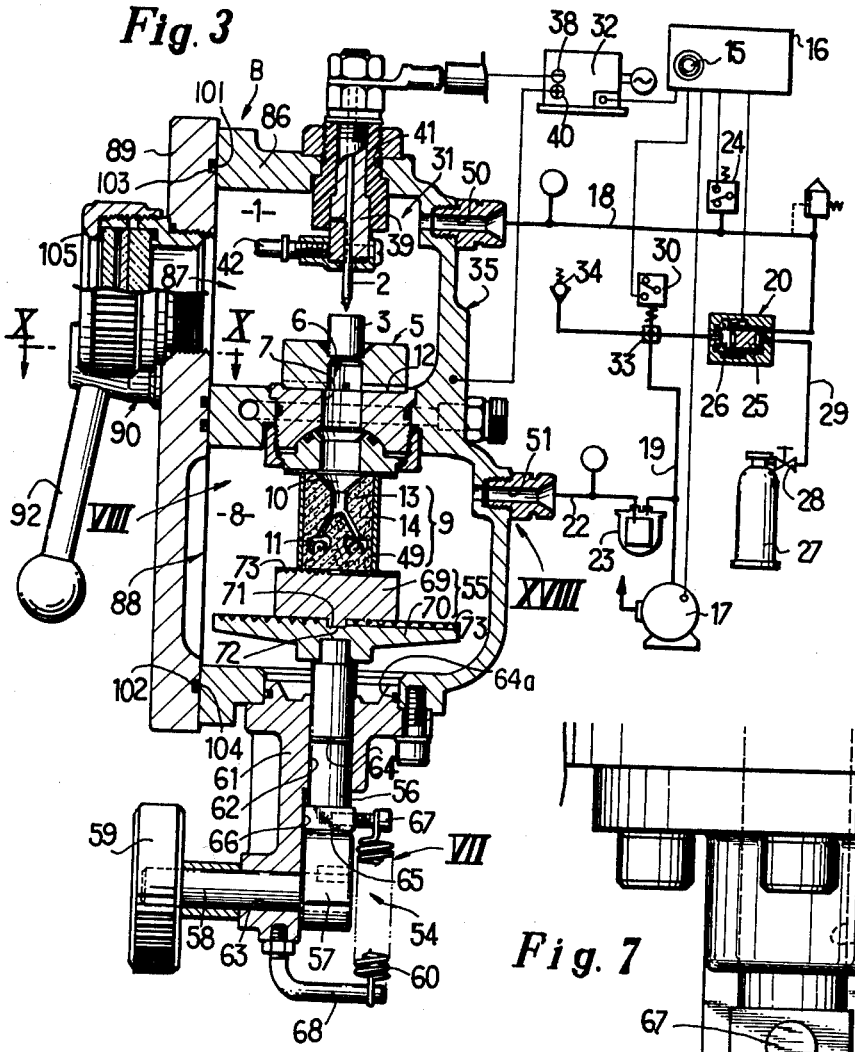
FIG. 3 is a vertical, longitudinal sectional view taken through the metal casting apparatus of FIG. 1, with the control circuit and allied components thereof being schematically shown.
Figure 7:
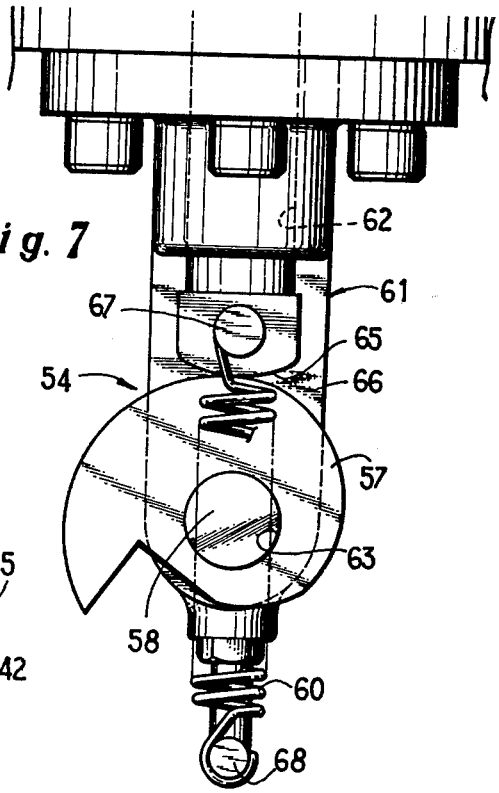
FIG. 7 is an enlarged, fragmentary front elevational view of the cam structure mounted on the bottom of the metal casting apparatus, taken generally at the arrow VII in FIG. 3.

Referring now to FIGS. 1-3 of the drawings, a cabinet A is shown within which is mounted the casting apparatus of the invention, the apparatus including a casting unit B having an upper, heating chamber 1 and a lower, molding chamber 8. When the casting unit B is in use, an electric arc 4 is produced in the heating chamber 1 between an electrode 2 and a body of casting metal 3 placed in a metal-heating crucible 5 disposed within said chamber. As is best shown in FIGS. 5*a* through 5*d*, the body of casting material 3 is melted from its top surface to the bottom thereof by the electric arc 4.

When the bottom portion of the body of casting material 3 has been completely melted, the molten metal 3*a* will then drop through an opening 6 provided in the bottom of the metal-heating crucible 5. This occurs because the bottom of the molten body of casting metal 3 has become fluid, and will thus no longer support the casting metal. The molten metal 3*a* passes along a pouring path 7 (FIG. 3), and pours into a mold 9 located in the molding chamber 8 and positioned directly below the metal-heating crucible 5 in communication therewith. The mold 9 includes an inlet port 10, cavities 11 formed within granular packing material 13, and a cylindrical frame 49 which embraces and confines the grains of the material 13. The reference number 14 indicates passageways provided among the packed grains of the granular material 13, through which a gas is passed, as will now be more particularly described.

The metal heating chamber 1 and the molding chamber 8 are filled with an inert gas, such as argon, for the period of time from the initiation of heating to the completion of molding. The presence of the inert gas during an operating cycle of the apparatus protects the casting metal against oxidizing or nitrifying. In addition, the gas is used to supplement the gravity flow of the molten metal.

The inert gas atmosphere is produced such that a pressure differential of about 4 kg/cm$^2$ exists between the chambers 1 and 8, with the heating chamber 1 having the higher pressure. Owing to the pressure differential, the inert gas is caused to flow from the heating chamber 1 to the molding chamber 8 via gas passageways 12, the pouring path 7, the inlet port 10 of the mold 9, and the molding cavities 11. As described above, the interior of the mold 9 is of a porous quality because of the passageways 14 formed between the grains of the packed granular material 13, and the inert gas flows through the passageways 14 about the grains, and then out of the bottom of the mold 9 into the molding chamber 8. The urging of the flowing inert gas stream assists the falling molten metal in flowing into the mold 9, and reaching the depths of the molding cavities 11.

In order to produce the inert gas atmosphere just described, and referring now in particular to FIG. 3, the chambers 1 and 8 are first subjected to air evacuation by means of a vacuum pump 17, which is operated by pressing a button 15 under the control of a sequence controller 16. The air in the heating chamber 1 is withdrawn via pipes 18 and 19, connected with the chamber 1 and the vacuum pump 17, respectively, and connected with each other by a three-way shuttle valve 20 and a coupler 33. Similarly, air is withdrawn from the molding chamber 8 through a pipe 22 and a strainer 23 connected therewith, and which in turn are connected to the pipe 19.

When the pressure values of the chambers 1 and 8 reach about 700 mmHg, a switch 24 is automatically operated and functions to shift the core 25 of the shuttle valve 20 to the left in FIG. 3, against a spring 26. Thus, the connection between the pipes 18 and 19 is broken, causing air evacuation from the chamber 1 to stop. An inert gas from a container 27 is then introduced under pressure into the heating chamber 1, via a regulator 28 and a pipe 29 connected to the shuttle valve 20, the shuttle valve 20, and the pipe 18. The regulator 28 will normally be set at about 3 kg/cm$^2$, thereby producing an inert gas atmosphere of about the same pressure value in the heating chamber 1.

Air evacuation from the molding chamber 8 is continued until molding is finished, assuring maintenance of a pressure differential between the chambers 1 and 8. When the molding is finished, the sequence controller 16 works to stop the operation of the vacuum pump 17, and the core 25 of the three-way shuttle valve 20 is then returned to the right in FIG. 3 by means of the spring 26. In this manner, both the air evacuation of the molding chamber 8 and the introduction of the inert gas into the heating chamber 1 are stopped. The inert gas remaining in the chamber 1 is drained to the atmosphere via the pipe 18, the shuttle valve 20, the coupler 33, and a check valve 34. The inert gas is partially withdrawn into the molding chamber 8 via the pipes 19 and 22, whereby atmospheric pressure is restored in both of the chambers 1 and 8. This completes a cycle of the molding process, with respect to the inert gas.

Turning now to the entire molding apparatus and process, reference is made in particular to FIGS. 2 and 3, wherein the casting unit B is shown to include a casting furnace 35 made of aluminum or a zinc alloy. The casting furnace 35 includes the upper, heating chamber 1 and the lower, molding chamber 8, which are separated by a wall or partition 36 having a central opening 77 therethrough, within which is received a sleeve fixture 37 containing the pouring path 7. An electrical heating unit 31 is mounted in the ceiling of the heating chamber 1, and includes the electrode 2, which is mounted to extend through the ceiling of the chamber 1 and projects downwardly toward the metal-heating crucible 5 mounted on the sleeve fixture 37.

The electrode 2 is arranged to generate an electric arc 4 between it and the body of casting metal 3 placed in the crucible 5. To produce the arc 4, voltage is impressed across the electrode 2 and the casting furnace 35 from an electric power supply 32, which has terminals 38 and 40 thereon. The terminal 38 is connected to the protruding tip of the electrode 2, and the other terminal 40 is grounded to the casting furnace 35. Thus, the casting furnace 35, the sleeve fixture 37, the crucible 5, and the body of casting metal 3 as a whole constitute an electrical path from the terminal 40 to the gap between the body of metal 3 and the electrode 2.

The electrode 2 is carried by a holder 39, which is secured in an airtight manner within an opening provided in the ceiling of the heating chamber 1 by an insulating fitting 41, and is preferably made of tungsten. The distance between the electrode 2 and the body of casting material 3 can be adjusted by means of an adjusting screw 42. The electrode 2 is slidable within its bore in the holder 39, but can be secured in a selected position with the screw 42.

Figure 5:
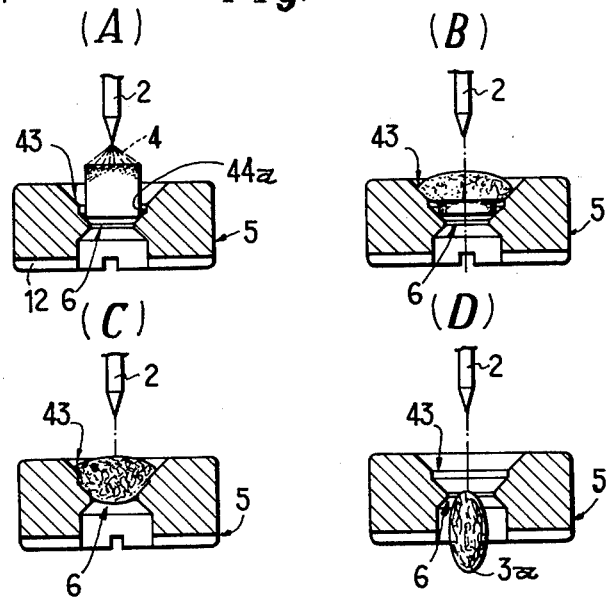
FIGS. 5*a* through 5*d* show in diagrammatic form the manner in which a body of casting metal is melted from the top to the bottom thereof within the metal-heating crucible of the invention, with FIG. 5*d* showing the molten casting metal passing downwardly out of the crucible.
Figure 4:
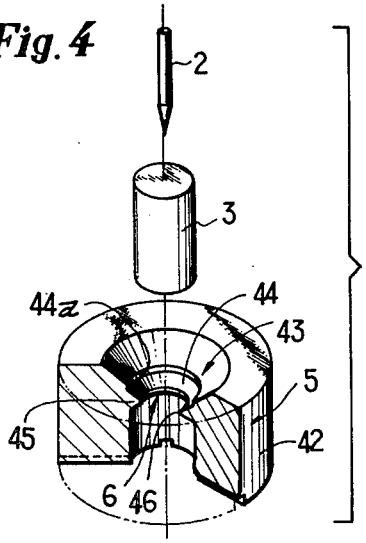
FIG. 4 is an enlarged, exploded perspective view showing the metal-heating crucible, a body of casting metal, and the electrode of the metal casting apparatus of FIG. 1.
Figure 6:
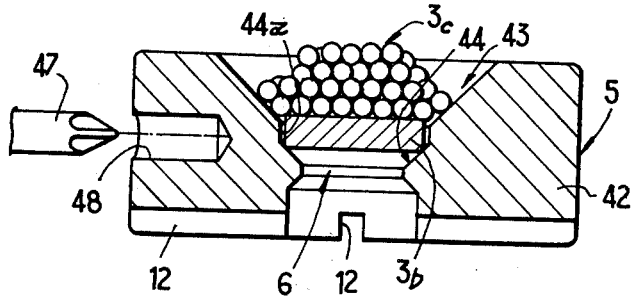
FIG. 6 is an enlarged, vertical sectional view of the metal-heating crucible of FIG. 4, shown with a body of irregular shaped casting material therein.

The construction of the preferred embodiment of the metal-heating crucible 5 is shown in detail in FIGS. 4–6, wherein the body thereof is indicated generally at 42. The body 42 is made of copper or any other suitable electrical conductor, and takes a cylindrical form. The upper surface of the body 42 has an inverted, truncated cone-shaped recess 43 centrally thereof for receiving a body of casting metal 3, the recess terminating at its lower end in a cylindrical intermediate bore 44*a*, the sidewall of which extends parallel with the longitudinal axis thereof. An inwardly projecting, annular rim 45 is positioned beneath the intermediate bore 44*a*, and defines the opening 6 through which molten metal exits the crucible 5. The opening 6 has a sidewall which also extends parallel with the longitudinal axis thereof, and has a diameter predetermined such that it will allow the molten casting metal to pass therethrough by gravity, against its surface tension.

The upper surface of the annular rim 45 has the shape of an inverted, truncated cone, and extends upwardly from the opening 6 to the lower end of the intermediate bore 44*a*. As shown in the drawings, the slope of the rim upper surface 44 is about the same as the slope of the recess 43, and preferably the upper and lower edges of the opening 6 are chamfered.

At least the lower portion of the body of casting metal 3 will have a cylindrical shape, and a diameter less than the diameter of the intermediate bore 44*a*, but greater than that of the opening 6. Thus, the lower end of the body 3 will rest centrally on the upper rim surface 43. The truncated cone configuration for the upper rim surface 43 assures that contact with the lower cylindrical end of the body 3 is minimal, which is advantageous in enabling the molten metal to flow smoothly with a minimum heat insulating effect; otherwise, the molten metal would readily become solid due to cooling, thereby causing clogging of the opening 6. The under surface 43*a* of the rim 43 is a truncated cone in shape, and the lower end thereof terminates in an enlarged cylindrical bore 43*b*.

When the body of casting metal 3 is placed in the crucible 5 with its lower edge resting on the sloping upper rim surface 43, communication between the crucible 5 and the mold 9 through the opening 6 is completely blocked, as is illustrated in FIG. 3 and FIG. 5*a*. When the casting furnace 35 is placed in operation and the electric arc 4 is formed, the casting metal 3 will be melted from the top down, as shown in FIGS. 5*a* through 5*d*. Owing to the conductive nature of the crucible body 42, the heat will be evenly transmitted, thereby avoiding a spot-by-spot melting of the casting metal. Because of the top-to-bottom melting process, the lower end of the body of casting metal will remain as a plug in the opening 6 until all of the metal has become molten and has reached the desired state of fluidity, related to a specific melting temperature. Thereafter, the molten metal will drop through the opening 6, as is shown in FIG. 5*d*.

The body of casting metal 3 can be cylindrical and well formed, as shown in FIGS. 4 and 5*a*. However, in some instances it is desirable to use at least some shapeless casting material, such as a casting waste. This is accommodated by the metal-heating crucible 5, as is shown in FIG. 6.

When using shapeless material, a circular plate 3*b* of the same material is first placed in the intermediate bore 44*a*, to rest on the upper rim surface 43. Then, the shapeless casting metal 3*c* is placed on the plate 3*b*, the intermediate bore 44*a* serving with the inclined recess 43 to center and position the casting metal 3*c*. Thereafter, melting of the metal proceeds as before, with the plate 3*b* retaining the metal until it is all molten and in a proper state.

The bottom face of the crucible body 42 is provided with grooves which form the gas passageways 12, and establish communication between the heating chamber 1 and the inlet 10 of the mold 9. As shown in the drawings, the groove passageways 12 are arrayed in a cross-shape; however, other arrangements are possible. The groove passageways 12 function to pass inert gas from the heating chamber 1 to the molding chamber 8, after the former has been filled with the gas and a pressure differential between the chambers 1 and 8 has been established, as has been described earlier. The inert gas, such as argon, performs the dual functions of helping to accelerate the falling molten metal, and preventing such from oxidizing or nitrifying.

The crucible body 42 is provided with a detachable handle 47 (FIG. 6), which is insertable into a blind hole 48 provided therein. When the crucible 5 is in operation, the handle 47 is removed. The handle 47 can be inserted into the hole 48 when it is desired to move the crucible 5, and thereafter the crucible can be lifted by the handle.

Turning now to the mold 9, the casing 49 thereof will usually be made of iron in the form of a cylinder. The granular packing material 13 is placed therein in the usual manner and forms the cavities 11. The passageways 14 will be located between the grains of the material 13 and the mold includes an inlet port 10. Between the opening 6 of the crucible 5 and the mold inlet port 10, there is formed the pouring path 7.

Air is withdrawn from and inert gas is admitted into the upper, heating chamber 1 through a port 50 located adjacent to the ceiling thereof, and which is connected to the pipe 18. Similarly, the lower, molding chamber 8 has a port 51, located near its ceiling and connected with the pipe 22. The manner by which the chambers 1 and 8 are evacuated of air—a pressure differential is formed therebetween, and an inert gas is introduced into the heating chamber 1 and flows into the lower chamber 8—has already been described.

Figure 8:
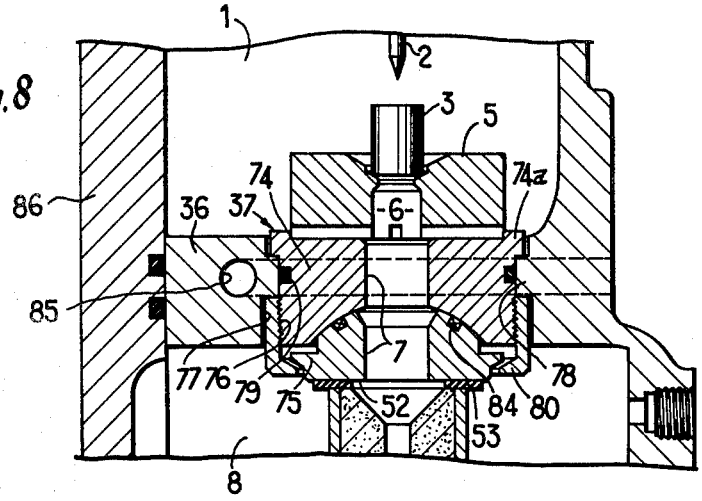
FIG. 8 is an enlarged, fragmentary vertical sectional view showing the arrangement for mounting the metal-heating crucible in the casting unit of the invention, and is taken generally at the arrow VIII in FIG. 3.
Figure 9:
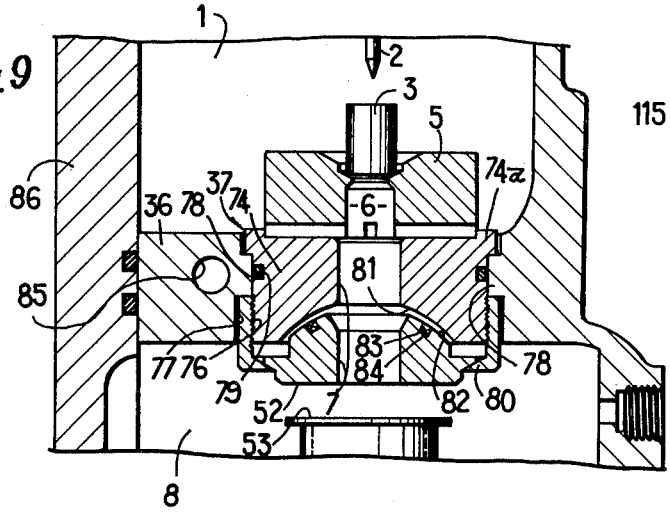
FIG. 9 is a view similar to FIG. 8, but showing the mold lowered so that it is not in contact with the bottom of the crucible assembly.

Referring now to FIGS. 8 and 9, the details of the sleeve fixture 37 for mounting the metal-heating crucible 5 are shown. The sleeve 37 includes an upper part 74 and a lower part 75, held in connected relationship by a screw thimble 76. The upper and lower parts 74 and 75 have aligned, vertical bores therethrough, which together define the flow path 7 from the crucible opening 6 to the mold inlet 10.

The opening 77 in the separating wall 36 has a relatively large diameter, and includes an annular projection 78 positioned between the upper and lower ends thereof. The upper part 74 of the sleeve fixture 37 has a flange **74*a* thereon, and is adapted to be received in the opening 77 so that the flange 74*a* comes to rest on the annular projection 78. The upper part 74 carries an O-ring 79 in a groove thereon, positioned to engage the cylindrical wall formed by the annular projection 78 when the flange 74*a*** is seated on the projection.

The lower end portion of the upper part 74 of the sleeve fixture 37 is cylindrical, and is threaded for receiving the screw thimble 76. The screw thimble 76 is tightened until the annular projection 78 is clamped between it and the flange **74*a*, whereby the sleeve assembly is firmly secured to the separating wall 36. The O-ring 79** assures a gas-tight relationship, and such is preferably made of heat-proof material.

The screw thimble 76 includes an inwardly directed flange 80 having a rounded upper surface which accommodates a like rounded surface on the lower part 75, and the bottom face of the upper part 74 has a concave surface 81 while the top face of the lower part 75 is formed as a mating convex surface 82. An O-ring 83 is carried in a groove 84 on the convex surface 82, to form a gas-tight seal. Like the O-ring 79, the O-ring 83 is preferably made of heat-proof material. The bottom face 52 of the lower part 75 is made flat, so as to receive the top end face of the mold 9 in a tight fit, with a gasket 53 clamped therebetween. By pressing the mold 9 upwardly against the gasket 52 as shown in FIG. 8, with the opening 6, the pouring path 7 and the inlet port 10 all in alignment, molten metal from the crucible 5 can pass together with inert gas from the grooves 12 into the mold 9. Because the lower part 75 is mounted for universal movement, misalignments can be accommodated.

The mold 9 is moved into and out of engagement with the sleeve fixture 37 by a pusher device 54, which includes a base 55 mounted on the upper end of a rod 56, the rod being slidably received within a bore 62 provided in a bracket 61 secured to the bottom wall of the casting furnace 35. An O-ring 64 is carried in a groove provided on the rod 56, to provide a seal between the rod and its bore 62, and the joint between the bracket 61 and the bottom wall of the furnace 35 is sealed by another O-ring **64*a***.

The base 55 of FIG. 3 includes a lower part 69 and an upper part 70, which are detachably doweled together by a projection 71 and a socket 72. Each of the base parts 69 and 70 has grooves 73 in the upper surface thereof, so as to facilitate a smooth flow of gas through a mold 9 resting thereon. The use of a two-part base 55 provides flexibility to accommodate molds 9 of different heights. When a relatively short mold 9 is being used, as in FIG. 3, the upper part 70 is employed. If a substantially taller mold than that shown in FIG. 3 is used, then the upper part 70 can be removed, and the taller mold can rest only on the upper surface of the lower base part 70. The presence of the grooves 73 on the upper surface of both of the base parts 70 and 69 assures good gas flow, regardless of which supports the mold.

The rod 56 is moved vertically within the bracket 61 by a cam 57, which is arranged to be engaged by a cam follower 65 connected with the bottom of the rod 56. The cam 57 is mounted on one end of a cam shaft 58 received in a transverse bore 63 provided in the bracket 61, the other end of the cam shaft 58 carrying a handle 59. A bracket arm 68 projects from the bottom of the bracket 61, and anchors the lower end of a spring 60. The upper end of the spring 60 is connected with a bolt 67 projecting from the cam follower 65, and the spring 60 functions to urge the rod 56 downwardly and to keep the cam follower 65 in engagement with the cam 57. The rear face of the cam follower 65 is flat and slides on a flat surface 66 formed on the bracket 61 to prevent turning of the rod 56 and any consequent misalignment between the cam follower 65 and the cam 57.

In operation, the handle 59 is first turned to lower the base 55, after which the mold 9 is placed on the base 55. Then, the handle 59 is turned in the opposite direction to raise the rod 56 and the base 55, whereby the top of the mold 9 is placed in engagement with the bottom face of the sleeve fixture 37.

Turning now to other structural features of the casting furnace 35, the sleeve fixture 37 is cooled by passing cooling fluid through a cooling jacket bore 85 provided in the separating wall 36, as shown in FIGS. 8 and 9. The front of the furnace 35 is provided with a flat face 86, provided with upper and lower openings 87 and 88 that give free access to the upper, heating chamber 1 and the lower, molding chamber 8, respectively. A door 89 is mounted by hinges 91 to mate in an airtight manner with the face 86, seals being formed by sealing rings 101 and 102 carried in grooves 103 and 104, respectively, provided on the mating face of the door 89. A window 105 in the door 89 permits viewing of the interior of the heating chamber 1.

Figure 10:
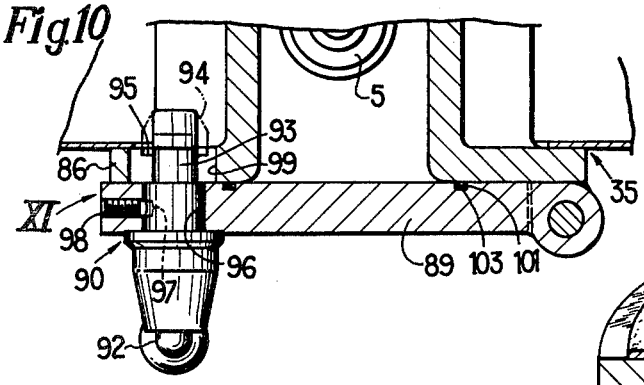
FIG. 10 is an enlarged, fragmentary sectional view taken generally along the line X—X in FIG. 3, showing details of the mechanism for locking closed the door of the casting unit.
Figure 11:
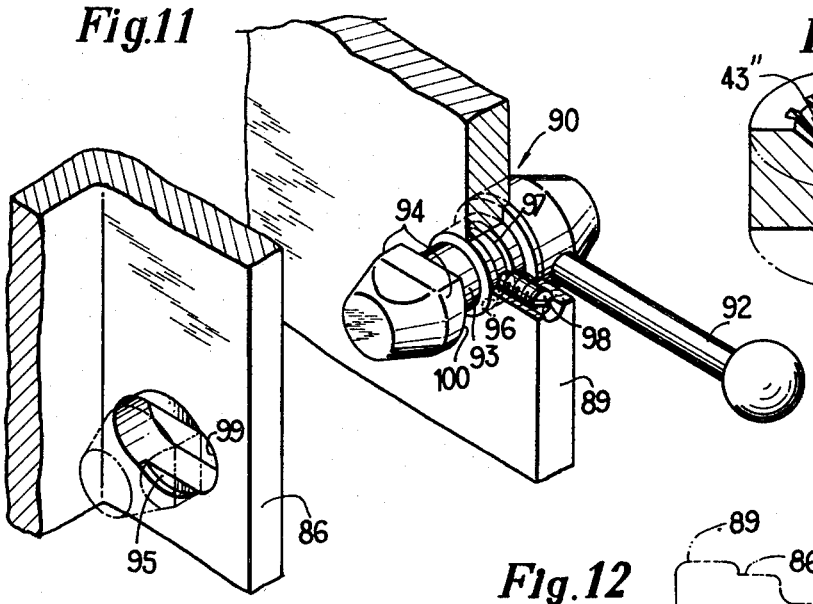
FIG. 11 is a fragmentary, enlarged perspective view further showing the arrangement of the mechanism for locking the door of the casting unit in a closed position, and is taken generally at the arrow XI in FIG. 10.

A latching arrangement is provided to ensure that the door 89 can be locked in its closed, airtight position, and such is illustrated in detail in FIGS. 10 and 11. The latch arrangement includes a rotary shaft 93 mounted within a bore 96 passing through the door, the outer end of the shaft 93 carrying a handle 92. The shaft 93 has an arcuate groove 97 therein which receives the tip of a stop screw 98 carried by the door 89, the groove 97 extending for about 90°. The groove 97 and the stopscrew 98 function to limit rotation of the shaft 93, and are arranged so that the handle 92 is movable between horizontal and vertical positions.

The inner end of the shaft 93 carries a pair of pawls 94, arranged symmetrically with respect to the axis of the shaft. The front face 86 of the furnace 35 has a mating apperture 99 therein, shaped to receive the pawls 94. The upper and lower rims 95 of the aperture 99 are recessed, and are adapted to receive slant cam faces 100 provided on the pawls 94. The arrangement is such that when the handle 92 is at one extreme of its movement, as determined by the groove 97 and the stop screw 98, the pawls 94 and their cam faces 100 can enter the aperture 99. Rotation of the shaft 96 through 90° will then cause the cam faces 100 to securely clamp the door 89 against the face 86, in a wedging action that will assure airtightness. The recesses 95 are adapted to initially receive the slant cam faces 100 of the pawls 94, and to then receive the pawls wholly therein during rotation of the shaft 96 from its open position to its closed and latching position.

Referring to the drawings, when the handle 92 is in its horizontal position as shown in FIG. 11, the door 89 can be freely opened about the hinges 91. After the door 89 has been closed, the handle 92 is rotated in a counterclockwise position until it is vertical, which causes the pair of pawls 94 to come into engagement with the recesses 95. Thereafter, when the door is to be opened the lever 92 is slowly moved back toward its horizontal position. In so returning the handle, after rotational movement of about 45°, a small gap will be opened between the face 86 and the door 89, and the seals carried thereon. However, the pawls 94 will still remain engaged in their recesses 95 at this stage of opening, thereby preventing the door 89 from opening explosively under a relatively high pressure that may be present in the chambers 1 and 8, but allowing such pressure to escape to the atmosphere. After any pressure that is present in the chambers 1 and 8 has been allowed to bleed off, the handle 92 can be fully moved to its horizontal, open position, and the door 89 safely opened.

Figure 12:
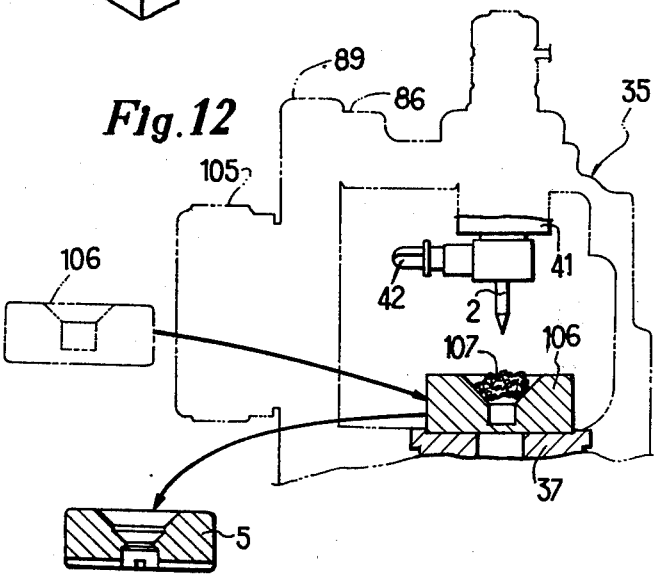
FIG. 12 is a diagrammatic view showing how a separate, shaping crucible is replaced for the metal-heating crucible, for use in molding a body of casting material into generally a mushroom shape.
Figure 13:
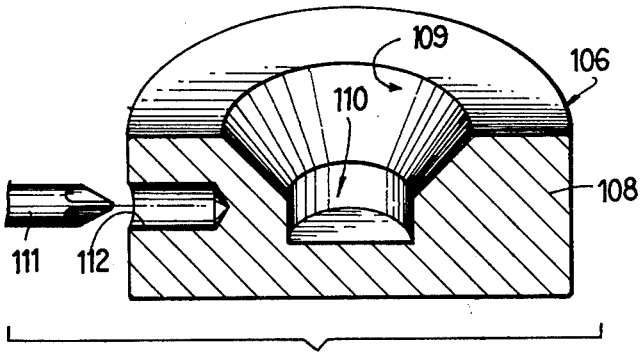
FIG. 13 is an enlarged, half-perspective view of the shaping crucible of FIG. 12.

Referring now to FIGS. 12 and 13, a modified crucible is shown at 106, which is especially useful for shaping a body of casting metal for use in the casting furnace 35. The shaping crucible 106 is simply substituted for the crucible 5, and is used to melt casting material odds and ends 107 into a convenient shape to form a slug for latter casting use. The odds and ends of casting material 107 are melted in the casting furnace 35 by an electric arc 4, in the same manner as described earlier, to form the slug. This can save on production cost, and leads to the saving of material.

As is best shown in FIG. 13, the shaping crucible 106 includes a body 108 made of an electrical conductor, such as copper or carbon, and has a short, cylindrical shape. The top surface of the crucible 106 has an inverted, truncated cone-shaped recess 109 therein, terminating at its lower end in a cylindrical recess 110. The body 108 is provided with a handle 111, which is removably receivable in a bore 112 in the body.

Figure 14:
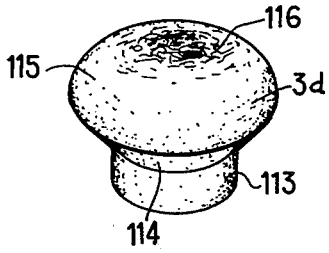
FIG. 14 is a perspective view of a body of casting material which has been molded into a mushroom shape, by use of the arrangement of FIG. 12.

Referring now to FIG. 14, there is shown a mushroom-shaped slug or body of casting material **3*d*, such as will typically be formed from scrap material 107 with use of the shaping crucible 106. When forming such a slug 3*d* within the casting furnace 35, it has been found that the impurities in the material will tend to gather at the top 116 of the mushroom. When this occurs, the impurities can then be removed simply by abrading the location 116 with a grinder or similar tool. Thereafter, the mushroom-shaped slug or body 3*d* is placed in the melting crucible 5, and is processed in the casting furnace 35** in the manner described above.

The shaping crucible 109 will form the mushroom-shaped slug or body **3*d* with a cylindrical trunk portion 113, an inverted, truncated cone portion 114, and a rounded head 115. The cylindrical recess 110 has a diameter smaller than the intermediate portion 44*a* of the melting crucible 5, so that the trunk portion 113 of the body will rest in line contact on the surface 44. This assures even transmission of heat in the body of casting material 3*d***, and a smooth flow of molten metal with the minimum possibility of cooling.

Certain additional modifications of the invention can also be made, as follows:

(1) The melting crucible 5 can be made of carbon, which sublimates at 3727° C. This point of subblimation stands higher than the temperature of the electric arc, thereby keeping the crucible 5 safe from sublimation due to the arc heating.

Figure 15:
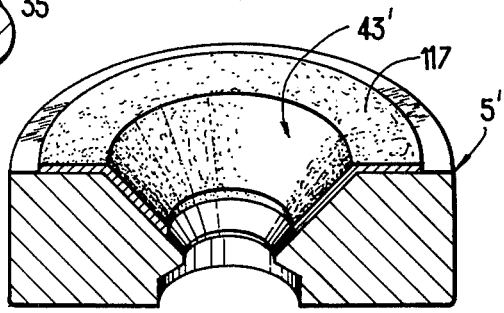
FIG. 15 is an enlarged, half-perspective view of a modified form of metal-heating crucible.

(2) As illustrated in FIG. 15, the inside surface 43' of a crucible 5' can be wholly or partially coated with a thermal insulating substance 117, thereby avoiding possible damage to the crucible caused by the electric arc or a heated metal. In addition, the coated surface 43' can conserve heat for a relatively long time, thereby preventing the molten metal from cooling rapidly.

Figure 16:
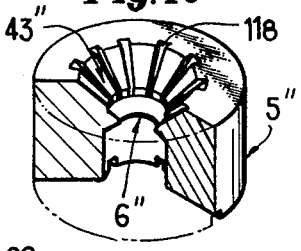
FIG. 16 is an enlarged, half-perspective view of another modified form of metal-heating crucible.

(3) As illustrated in FIG. 16, the inside surface of the recess 43'' of a melting crucible 5'' can be provided with a plurality of radial grooves 118 for insulating heat to the body of the crucible, wherein the width and depth of the grooves 118 are determined such that the surface tension of the molten metal is adequate to prevent the molten metal from entering the grooves. Thus, the molten metal is protected against its rapid cooling in the recess 43'', but can still flow through the opening 6''.

(4) The slant surface 44 of the recess 43 in the melting crucible 5 can be provided with one or more steps, or can be convexed or concaved, if so desired.

(5) The slant surface 44 in the recess 43 of the melting crucible 5 can be made rectangular, or of any other polygonal shape, such as pentagonal, hexagonal, in accordance with the sectional shape of the body of casting metal.

Figure 17:
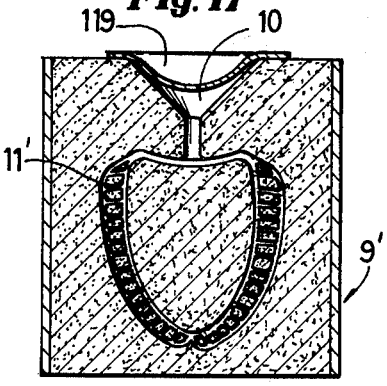
FIG. 17 is an enlarged, vertical sectional view through a modified casting mold.

(6) When the mold cavities 11' of a mold 9' are delicate and complicated, as illustrated in FIG. 17 for example, thereby increasing the difficulty in obtaining deep penetration of molten metal therein, the inlet port 10' can be initially covered with a tray 119 of air impenetrable quality, so as to initially block the gas stream from entering the cavities 11'. Thus, gas pressure will then accumulate on the tray 119, while the space thereunder remains at a low pressure. At this stage the molten metal is poured into the inlet port 10', and the tray 119 is readily melted away to enable the molten metal to pass through the inlet port 10' under a relatively large pressure gap. In this way, the flow of the molten metal accelerates and penetrates more deeply into the fine cavities 11'.

(7) The extra shaping crucible 106 illustrated in FIGS. 12 and 13 can replace the mold 9 or 9' for molding a body of casting metal of irregular shapes to the desirable form illustrated in FIG. 14.

Figure 18:
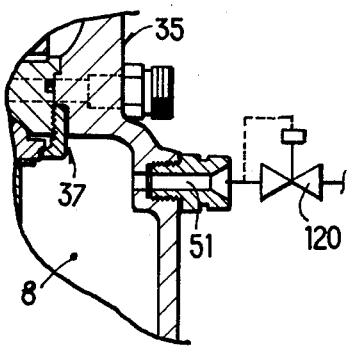
FIG. 18 is a schematic view showing a modified arrangement for the gas port of the molding chamber of the casting unit, the gas port being indicated generally at XVIII in FIG. 3.

(8) Referring to FIG. 18, a gas pressure regulator 120 can be provided at the outlet of the gas drain port 51, so as to control the internal pressure of the molding chamber 8, whereby such internal pressure is not reduced to become negative but, rather, is kept positive. This eliminates the possibility of pinholes and blowholes forming in the cast product. In this case, it is required that the internal gas pressure in the heating chamber 1 be kept relatively high.

Other modifications and variations of the preferred embodiments can also be made without departing from the spirit of the present invention.

What is claimed is:

1. A metal casting apparatus, including:

a casting furnace including an upper, first chamber, and a lower, second chamber positioned beneath said first chamber, said first and said second chambers being divided by generally horizontal separating wall means;

means forming a vertically extending liquid passageway through said separating wall means between said first chamber and said second chamber;

a crucible made of electrically conductive material received within said first chamber and supported on said separating wall means, said crucible having a recess therein for receiving a body of casting metal and supporting the lower end thereof, and an opening therethrough extending from the bottom of said recess downwardly to the bottom surface of said crucible, said crucible opening being smaller in diameter than the lower end of said body of casting metal and being dimensioned such that when said body of casting metal has been completely melted and placed in a molten state it will flow freely therethrough by gravity without the employment of any additional flow causing means;

said crucible being placed on said separating wall means with said crucible opening in communication with said liquid passageway, and said crucible having open gas passage means therein leading from the outer diameter thereof to a location on the surface of said crucible opening beneath said crucible recess to thereby freely communicate said first chamber with both said crucible opening and said liquid passageway;

mold means received within said second chamber, and including a mold cavity having an inlet;

means supporting said mold means within said second chamber, with said mold inlet in communication with said passageway;

electrode means mounted within said first chamber on the ceiling thereof above said crucible, said electrode means being vertically adjustable for adjusting the gap between said electrode means and the upper end of a body of casting metal received in said crucible recess; and power supply means connected with said electrode means;

said electrode means and said power supply means being connected and arranged to establish an electric arc between said electrode means and the upper end of a body of casting metal received in said crucible recess, effective to melt said body of casting metal downwardly from the top to the bottom thereof, the lower end of said body of casting metal serving to block liquid flow through said crucible opening until all of said body of casting metal has been placed in a molten state by said electric arc.

2. A metal casting apparatus as recited in claim 1, wherein said open gas passage means in said crucible comprises at least one groove cut into the bottom surface of said crucible, and leading from the outer diameter thereof to said crucible opening.

3. A metal casting apparatus as recited in claim 1, wherein said crucible recess includes a lower portion, an intermediate portion of larger diameter than said lower portion and having a sidewall that extends parallel with the vertical axis of said recess, and an upper portion of larger diameter than said intermediate portion.

4. A metal casting apparatus as recited in claim 1, wherein the surface of said crucible recess adapted to support said body of casting metal has the shape of an inverted truncated cone.

5. A metal casting apparatus as recited in claim 1, wherein said crucible recess includes an upper portion having the shape of an inverted truncated cone;

an intermediate cylindrical portion extending downwardly from the bottom of said upper portion; and a lower portion at the bottom end of said intermediate portion, said lower portion having the shape of an inverted truncated cone and being adapted to support a body of casting metal, and said crucible opening extending downwardly from the lower end of said lower portion.

6. A metal casting apparatus as recited in claim 1, wherein said crucible is made of a material having a relatively high thermal conductivity factor.

7. A metal casting apparatus as recited in claim 6, wherein said thermally conductive material is carbon.

8. A metal casting apparatus as recited in claim 1, wherein said crucible recess has a peripheral portion which is coated with a thermal insulating substance.

9. A metal casting apparatus as recited in claim 1, wherein said crucible recess has its inside surface coated with a thermal insulating substance.

10. A metal casting apparatus as recited in claim 1, wherein the inside surface of said crucible recess is provided with circumferentially spaced radial grooves extending upwardly from said crucible opening, and whose width and depth are dimensioned such that the surface tension of melted casting metal received within said recess can prevent such molten metal from entering said radial grooves.

11. A metal casting apparatus as recited in claim 1, including additionally:

first port means connected with said first chamber;

second port means connected with said second chamber;

suction means;

a source of pressurized inert gas; and conduit means connecting all of said first and said second port means, said suction means, and said source of pressurized inert gas, arranged and operable to first withdraw pressure from said first and said second chambers, and to then admit pressurized inert gas to said first chamber while still withdrawing pressure from said second chamber.

12. A metal casting apparatus as recited in claim 11, wherein said mold means includes:

an outer housing; and granular material packed within said outer housing and forming said mold cavity and said mold inlet, the grains of said granular material being chosen and packed within said outer housing such that flow spaces are provided therebetween for passage of said inert gas therethrough.

13. A metal casting apparatus as recited in claim 12, wherein said means supporting said mold means is vertically adjustable and is adapted to clamp said mold means against the underside of said separating wall means with said mold inlet in alignment with said passageway, said means supporting said mold means including a base upon which said mold means rests, and said base having passageways therein for accommodating gas flow, whereby said inert gas can flow from said first chamber, through said crucible and said mold means, and then through said base passageways into said second chamber.

14. A metal casting apparatus, including:

a casting furnace including an upper, first chamber, and a lower, second chamber positioned beneath said first chamber, said first and said second chambers being divided by generally horizontal separating wall means;

means forming a vertically extending liquid passageway through said separating wall means between said first chamber and said second chamber;

first port means connected with said first chamber;

second port means connected with said second chamber;

suction means;

a source of pressurized inert gas;

conduit means connecting all of said first and said second port means, said suction means, and said source of pressurized inert gas, arranged and operable to first withdraw pressure from said first and said second chambers, and to then admit pressurized inert gas to said first chamber while still withdrawing pressure from said second chamber;

a crucible made of electrically conductive material received within said first chamber and supported on said separating wall means, said crucible having a recess therein for receiving a body of casting metal, and an opening therethrough extending from the bottom of said recess to the bottom surface of said crucible, said crucible opening being dimensioned such that casting metal in a molten state can flow therethrough by gravity without the employment of any additional flow causing means, and said crucible being placed with said opening in communication with said passageway;

mold means received within said second chamber, and including a mold cavity having an inlet, said mold means comprising:

an outer housing;

granular material packed within said outer housing and forming said mold cavity and said mold inlet, the grains of said granular material being chosen and packed within said outer housing such that flow spaces are provided therebetween for passage of said inert gas therethrough; and a gas impenetrable cover airtightly placed over said mold inlet, said cover being made of a heat fusible material, and functioning to temporarily block a stream of inert gas from entering said mold cavity until said cover is melted away by molten casting metal flowing downwardly through said passageway;

means supporting said mold means with said second chamber, with said mold inlet in communication with said passageway, said supporting means being vertically adjustable and adapted to clamp said mold means against the underside of said separating wall means with said mold inlet in alignment with said passageway, and including a base upon which said mold means rests, said base having passageways therein for accommodating gas flow whereby said inert gas can flow from said first chamber, through said crucible and said mold means, and then through said base passageways into said second chamber;

electrode means mounted within said first chamber above said crucible; and power supply means connected with said electrode means;

said electrode means and said power supply means being connected and arranged to establish an electric arc between said electrode means and a body of casting metal received in said crucible recess, effective to melt said body of casting metal from the top to the bottom thereof.

15. A metal casting apparatus, including:

a casting furnace including an upper, first chamber, and a lower, second chamber positioned beneath said first chamber, said first and said second chambers being divided by generally horizontal separating wall means, and said separating wall means having an opening extending therethrough;

means forming a vertically extending liquid passageway through said separating wall means between said first chamber and said second chamber;

a crucible made of electrically conductive material received within said first chamber and supported on said separating wall means, said crucible having a recess therein for receiving a body of casting metal, and an opening therethrough extending from the bottom of said recess to the bottom surface of said crucible, said crucible opening being dimensioned such that casting metal in a molten state can flow therethrough by gravity without the employment of any additional flow causing means, and said crucible being placed with said opening in communication with said passageway;

mold means received within said second chamber, and including a mold cavity having an inlet;

means supporting said mold means within said second chamber, with said mold inlet in communication with said liquid passageway;

said means forming said liquid passageway comprising a sleeve fixture mounted within said separating wall means opening, and said fixture including:

an upper unit extending through said opening in and secured to said separating wall means, said upper unit being adapted to support said crucible thereon and having a vertically extending passage therethrough, and the lower end face thereof having a spherically concave surface disposed concentrically about the lower end of said upper unit passage;

a lower unit having a vertical passage therethrough and provided with an engagement face on the bottom thereof for mating with the upper end of said mold means, the upper end of said lower unit having a spherically convex surface extending concentrically about said lower unit passage and adapted to matingly engage said spherically concave surface on the lower end of said upper unit; and means for clamping said lower unit to said upper unit with said convex and said concave surfaces in sealing engagement with each other, whereby said lower unit is universally adjustable to allow for proper alignment with said mold means when such is engaged against said engagement face;

electrode means mounted within said first chamber above said crucible; and power supply means connected with said electrode means;

said electrode means and said power supply means being connected and arranged to establish an electric arc between said electrode means and a body of casting metal received in said crucible recess, effective to melt said body of casting metal from the top to the bottom thereof.

16. A metal casting apparatus as recited in claim 1, wherein said casting furnace further includes:

a body containing said first chamber and said second chamber, said body including a front face, and said first chamber and said second chamber opening onto said front face;

a door hinged to said body, and arranged to sealingly engage said front face of said body to thereby close said first and said second chambers; and latching means carried by said door and engageable with said body, constructed and arranged to unlock in two steps, a first step wherein said door is retained in a latched position but is unsealed from said front face to allow pressure to escape from said first and said second chambers, and a second unlatched position in which said door can be freely moved to an open position.

17. A metal casting apparatus as recited in claim 16, wherein said latching means includes:

a shaft rotatably mounted on said door to extend toward said front face of said body, the outer end of said shaft having a handle thereon;

at least one pawl on the inner end of said shaft, said pawl including a slant cam face; and said front face of said body having an aperture therein for receiving the inner end of said shaft and said pawl, said aperture including a recess adapted to receive said slant cam face therein.

18. A metal casting apparatus as recited in claim 1, wherein said means for supporting said mold means within said second chamber includes:

a vertically disposed rod mounted within said second chamber, and arranged to be vertically movable;

base means mounted on the upper end of said rod, and adapted to support said mold means; and means arranged and operable to move said vertically disposed rod upwardly and downwardly, to alternately engage and disengage the upper end of mold means carried by said base means with said means forming a vertically extending liquid passageway through said separating wall means.

19. A metal casting apparatus as recited in claim 18, wherein said means for moving said vertically disposed rod upwardly and downwardly includes:

a cam mounted beneath said rod;

a cam follower on the lower end of said rod, arranged to ride on said cam; and shaft means connected with said cam and having a handle thereon, adapted to be rotated by said handle to thereby move said cam and effect vertical movement of said rod.

20. A metal casting apparatus as recited in claim 19, including additionally;

spring means connected and arranged to urge said vertically movable rod toward said cam, for keeping said cam follower in engagement with said cam.

* * * * *